US008755733B2

(12) United States Patent
Ehara et al.

(10) Patent No.: US 8,755,733 B2
(45) Date of Patent: Jun. 17, 2014

(54) FIXING DEVICE, FIXING METHOD, IMAGE FORMING APPARATUS, AND IMAGE FORMING METHOD

(75) Inventors: Masanao Ehara, Kanagawa (JP); Tadashi Ogawa, Tokyo (JP); Satoshi Ueno, Tokyo (JP); Hiroshi Seo, Kanagawa (JP); Shuutaroh Yuasa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 288 days.

(21) Appl. No.: 13/049,181

(22) Filed: Mar. 16, 2011

(65) Prior Publication Data

US 2011/0229236 A1 Sep. 22, 2011

(30) Foreign Application Priority Data

Mar. 17, 2010 (JP) ..... 2010-061661

(51) Int. Cl.
*G03G 15/00* (2006.01)

(52) U.S. Cl.
USPC ..... 399/400; 399/33; 399/66; 399/67; 399/68; 399/69; 399/320; 399/322; 399/397

(58) Field of Classification Search
CPC ..... G03G 15/2039; G03G 15/2078
USPC ..... 399/400, 33, 67–70, 66, 122, 320, 322, 399/397
See application file for complete search history.

(56) References Cited

U.S. PATENT DOCUMENTS 5,400,123 A 3/1995 Sato et al.
5,832,354 A 11/1998 Kouno et al.
5,895,152 A * 4/1999 Ide et al. ..... 399/322
5,915,147 A 6/1999 Kouno et al.
6,219,520 B1 4/2001 Ehara
6,327,444 B1 * 12/2001 Hachisuga ..... 399/45
6,628,916 B2 9/2003 Yasui et al.
6,636,709 B2 10/2003 Furukawa et al.
6,778,790 B2 8/2004 Yoshinaga et al.
6,785,505 B2 8/2004 Yasui et al.
6,807,386 B2 10/2004 Yasui et al.
6,881,927 B2 4/2005 Yoshinaga et al.
6,892,044 B2 5/2005 Yasui et al.
7,022,944 B2 4/2006 Yoshinaga et al.

(Continued)

FOREIGN PATENT DOCUMENTS

JP 01316777 A * 12/1989
JP 6-230626 8/1994

(Continued)

*Primary Examiner* — Matthew G Marini
*Assistant Examiner* — Allister Primo
(74) *Attorney, Agent, or Firm* — Oblon, Spivak, McClelland, Maier & Neustadt, L.L.P.

(57) ABSTRACT

A fixing device in an image forming apparatus includes a conveyance member to convey a recording medium at a fixing nip where an image carried on the recording medium is fixed onto it; a plurality of temperature detectors to detect temperature of the conveyance member, the detectors being disposed at both end portions of the conveyance member outside an area where a maximum-sided recording medium passes through; a guide member to guide the recording medium toward the fixing nip; and a guide plate displacing unit to displace a part of the guide member in a direction orthogonal to a conveyed surface of the recording medium to be conveyed at the fixing nip, based on temperature difference detected by the plurality of temperature detectors.

10 Claims, 8 Drawing Sheets

(56) References Cited

U.S. PATENT DOCUMENTS

| | | | | |
|---|---|---|---|---|
| 7,266,336 | B2 * | 9/2007 | Ueno et al. | 399/329 |
| 7,450,872 | B2 * | 11/2008 | Ueno et al. | 399/69 |
| 7,491,917 | B2 | 2/2009 | Ueno | |
| 7,509,085 | B2 | 3/2009 | Yoshinaga et al. | |
| 7,546,049 | B2 * | 6/2009 | Ehara et al. | 399/69 |
| 7,693,439 | B2 | 4/2010 | Seo et al. | |
| 7,715,774 | B2 | 5/2010 | Ueno | |
| 7,734,208 | B2 | 6/2010 | Seo et al. | |
| 7,742,714 | B2 | 6/2010 | Shinshi et al. | |
| 7,778,581 | B2 | 8/2010 | Seo et al. | |
| 7,783,240 | B2 | 8/2010 | Ito et al. | |
| 7,796,933 | B2 | 9/2010 | Ueno et al. | |
| 7,801,457 | B2 | 9/2010 | Seo et al. | |
| 7,817,952 | B2 | 10/2010 | Seo et al. | |
| 7,885,590 | B2 | 2/2011 | Seo et al. | |
| 2002/0141772 | A1 * | 10/2002 | Kawano | 399/68 |
| 2006/0029411 | A1 | 2/2006 | Ishii et al. | |
| 2006/0257183 | A1 | 11/2006 | Ehara et al. | |
| 2007/0003334 | A1 | 1/2007 | Shinshi et al. | |
| 2007/0014600 | A1 | 1/2007 | Ishii et al. | |
| 2007/0280754 | A1 | 12/2007 | Ogawa et al. | |
| 2008/0025773 | A1 | 1/2008 | Ito et al. | |
| 2008/0063443 | A1 | 3/2008 | Yoshinaga et al. | |
| 2008/0279576 | A1 * | 11/2008 | Kim et al. | 399/69 |
| 2008/0317532 | A1 | 12/2008 | Ehara et al. | |
| 2009/0060550 | A1 | 3/2009 | Seo | |
| 2009/0123201 | A1 | 5/2009 | Ehara et al. | |
| 2009/0148204 | A1 | 6/2009 | Yoshinaga et al. | |
| 2009/0148205 | A1 | 6/2009 | Seo et al. | |
| 2009/0245897 | A1 | 10/2009 | Seo et al. | |
| 2010/0074667 | A1 | 3/2010 | Ehara et al. | |
| 2010/0158553 | A1 | 6/2010 | Ueno | |

FOREIGN PATENT DOCUMENTS

| | | |
|---|---|---|
| JP | 8-254913 | 10/1996 |
| JP | 10-282830 | 10/1998 |
| JP | 2002-6656 | 1/2002 |

* cited by examiner

FIG. 7

| TEMPERATURE DIFFERENCE | PAPER TYPE | PAPER THICKNESS | HEIGHT OF CENTRAL PORTION OF ENTRANCE GUIDE PLATE | | | | | | | |
|---|---|---|---|---|---|---|---|---|---|---|
| | | (g/m²) | 0mm | +0.5mm | +1.0mm | +1.5mm | +2.0mm | +2.5mm | +3.0mm | +3.5mm |
| ΔT<10°C | THIN PAPER | ~ 59 | ○ | ○ | ○ | ○ | ○ | ○ | × | × |
| | PLAIN PAPER | ~ 90 | ○ | ○ | ○ | ○ | ○ | ○ | × | × |
| | THICK PAPER | ~ 256 | ○ | ○ | ○ | ○ | ○ | ○ | ○ | ○ |
| 10°C≦ΔT<20°C | THIN PAPER | ~ 59 | × | × | ○ | ○ | ○ | ○ | × | × |
| | PLAIN PAPER | ~ 90 | × | × | × | ○ | ○ | ○ | ○ | ○ |
| | THICK PAPER | ~ 256 | × | × | × | × | ○ | ○ | ○ | ○ |
| 20°C≦ΔT | THIN PAPER | ~ 59 | × | × | × | × | × | × | × | × |
| | PLAIN PAPER | ~ 90 | × | × | × | × | × | × | × | × |
| | THICK PAPER | ~ 256 | × | × | × | × | × | × | × | × |

FIXING DEVICE, FIXING METHOD, IMAGE FORMING APPARATUS, AND IMAGE FORMING METHOD

CROSS-REFERENCE TO RELATED APPLICATIONS

The present application claims priority from Japanese patent application number 2010-061661, filed on Mar. 17, 2010, the entire contents of which are incorporated by reference herein.

BACKGROUND OF THE INVENTION

1. Field of the Invention

The present invention relates to a fixing device included in an image forming apparatus such as a copier, printer, facsimile machine, or the like, to fix an image carried on a recording medium onto it, a fixing method, and an image forming apparatus employing such a fixing device and an image forming method employing such a fixing method.

2. Description of the Related Art

In conventional fixing devices as disclosed in JP-2002-006656-A, JP-H06-230626-A, JP-H08-254913-A, and JP-H10-282830-A, when a recording medium is conveyed or passed through a fixing nip to exert fixing effect, there occurs a problem of creases and curls in the recording medium. Such a problem tends to occur easily with conveyance members such as a fixing roller, heat roller, pressure roller and the like, to convey a recording medium that are made thin or made to have a low heat capacity due to the recent trend for the low energy consumption. By making the conveyance member thinner, heat transfer speed in the width direction of the conveyance member decreases and temperature thereon varies, resulting in variations in the shape of the thermally expanded conveyance member in the width direction, whereby the conveyance property of the recording medium varies in the width direction and creases and curls occur to the recording medium.

As an aspect of the temperature variations in the conveyance member, there is a case in which temperature difference occurs between one side of the conveyance member in the width direction and another side thereof. Such a phenomenon occurs as follows.

When the conveyance member is driven to rotate for conveying the recording medium, in general, a mechanism to drive the conveyance member is provided at one end side in the width direction of the conveyance member. In such a case, when the driving mechanism acts on a heat absorbing side, the temperature at one end side of the conveyance member decreases faster than the temperature of another end side thereof, to thus vary the temperature.

It is known to use air to prevent excessive temperature rise of the fixing device. When, for example, air is blown from a first lateral side of the conveyance member to a second side, more heat is absorbed at the first side than the second. Therefore, the temperature at the one end side of the conveyance member decreases more than that of another end side thereof, to thus cause temperature variations.

Also even in such a case in which temperature difference occurs from one side to another in the width direction of the conveyance member, as described above, shape difference of the conveyance member due to the thermal expansion occurs in the width direction caused by the temperature difference. Then, when the recording medium is passed through the fixing nip, creases and curls are formed to the recording medium and the fixing property varies.

However, conventionally, no optimal technology has been disclosed capable of preventing creases and curls in the recording medium and variations in the fixing property, in view of the cases in which temperature difference occurs between one end side of the conveyance member in the width direction and another end side thereof.

SUMMARY OF THE INVENTION

Accordingly, the present invention provides a novel fixing device, included in an image forming apparatus, to fix an image carried on a recording medium onto it, a novel fixing method used in the fixing device which is in particular capable of preventing creases and curls occurring to the recording medium due to the temperature difference between one end side in the width direction of the conveyance member and another end side thereof.

As an aspect of the present invention to achieve the above objective, the fixing device includes: a conveyance member to convey a recording medium at a fixing nip where an image is carried on the recording medium is fixed onto it; a plurality of temperature detectors disposed at both end portions of the conveyance member outside an area where a maximum-sized recording medium passes through; a guide member including a guide plate to guide the recording medium toward the fixing nip; and a guide plate displacing unit to displace part of the guide member in a direction orthogonal to a conveyed surface of the recording medium to be conveyed at the fixing nip based on temperature difference detected by the plurality of temperature detectors.

These and other objects, features, and advantages of the present invention will become apparent upon consideration of the following description of the preferred embodiments of the present invention when taken in conjunction with the accompanying drawings.

BRIEF DESCRIPTION OF THE DRAWINGS

FIG. 7 is a table showing temperature difference detected by each temperature detector as illustrated in FIG. 4 and height of the central portion of the entrance guide plate, and effects thereof exerted to the recording medium to be fixed and to the fixing operation;

DESCRIPTION OF THE PREFERRED EMBODIMENTS

Preferred embodiments of the present invention will now be described with reference to drawings.

Figure 1:
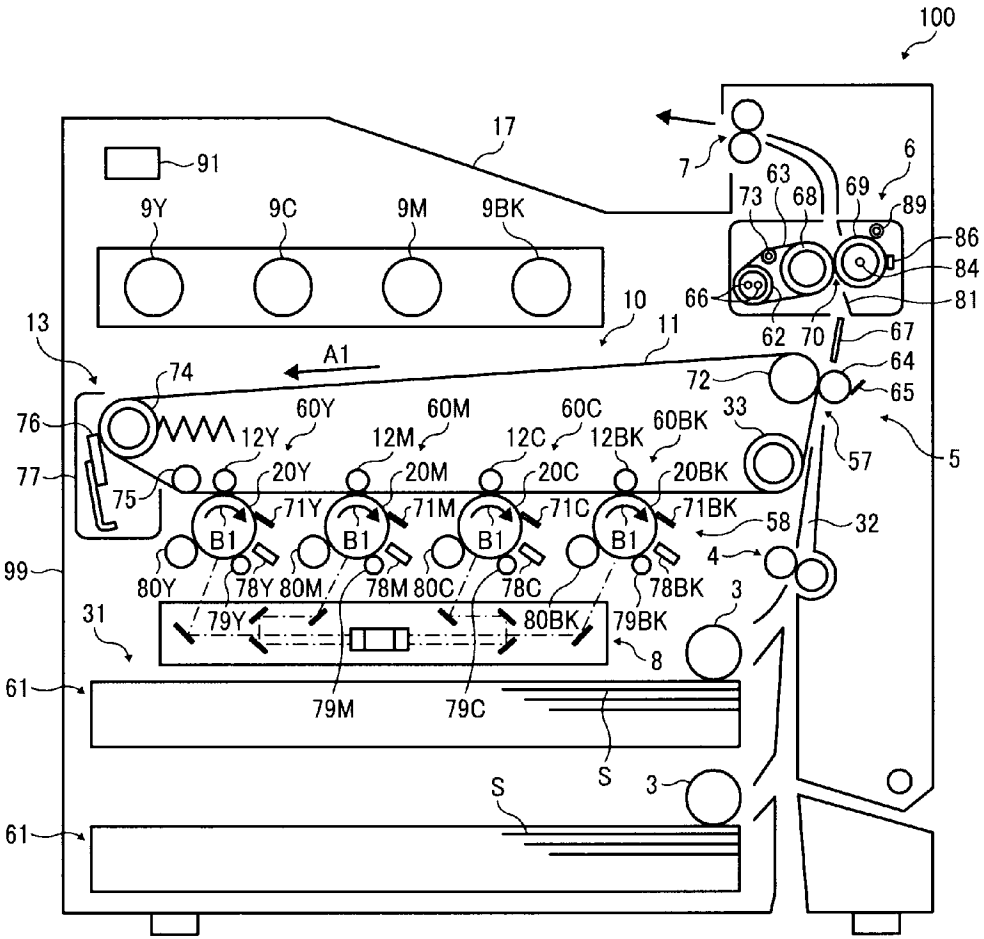
FIG. 1 is a front view of an image forming apparatus to which a present invention is applied.

FIG. 1 is a schematic view of an image forming apparatus to which the present invention is applied. An image forming apparatus 100 is a color laser printer according to an embodiment of the present invention. However, the image forming apparatus 100 may be another type of printer, facsimile machine, copier, printer, or multifunctional printer serving as a copier as well as a printer. The image forming apparatus 100 performs image formation based on image signals corresponding to image information received from outside and may use any type of sheet-shaped recording materials including a plain paper generally used for copying, OHP sheets, thick paper such as cards or postcards, and envelops.

Photoreceptor drums 20Y, 20M, 20C, and 20BK are first image carriers or latent image carriers, each capable of forming an image corresponding to a color which is color-separated into each color of yellow, magenta, cyan, and black, by carrying toner as an image forming substance. The image forming apparatus 100 uses a tandem method in which the photoreceptor drums 20Y, 20M, 20C, and 20BK are disposed in parallel.

The image forming apparatus 100 includes an endless belt-shaped transfer belt 11 which is an intermediate transfer body as a flexible second image carrier and is rotatably supported by a frame, not shown, of a main body 99 of the image forming apparatus 100. The transfer belt 11 moves to rotate in the counterclockwise direction as illustrated in FIG. 1 by an arrow A1. The photoreceptor drums 20Y, 20M, 20C, and 20BK are disposed in this order from upstream to downstream of the belt running direction A1. Suffixes of Y, M, C, and BK added after each reference numeral show yellow, magenta, cyan, and black, respectively.

The photoreceptor drums 20Y, 20M, 20C, and 20BK are supported by image forming units 60Y, 60M, 60C, and 60BK, respectively, each of which forms an image of yellow (Y), magenta (M), cyan (C), and black (BK).

The photoreceptor drums 20Y, 20M, 20C, and 20BK are disposed on an outer circumferential surface or an image forming surface of the transfer belt 11 which is disposed substantially in the center of the main body 99.

The transfer belt 11 is movable in the arrow A1 direction being opposite each of the photoreceptor drums 20Y, 20M, 20C and 20BK. A visual image or toner image is formed on each of the photoreceptor drums 20Y, 20M, 20C, and 20BK. The visual images are then transferred superimposedly onto the transfer belt 11 moving in the direction indicated by arrow A1, and thereafter, the superimposed image is transferred en bloc onto a transfer sheet S being a recording medium. The present image forming apparatus 100 is based on a so-called intermediate transfer method or indirect transfer method. The image forming apparatus 100 is then defined to be a tandem-type indirect transfer method apparatus.

The transfer belt 11 is disposed opposite each of the photoreceptor drums 20Y, 20M, 20C, and 20BK in the lower portion thereof. This opposite portion forms a first transfer section 58 in which toner images on the photoreceptor drums 20Y, 20M, 20C, and 20BK are transferred to the transfer belt 11.

The superimposed transfer of the toner images to the transfer belt 11 is performed such that the toner images formed on the photoreceptor drums 20Y, 20M, 20C, and 20BK are transferred at a same position on the transfer belt 11 while the transfer belt 11 moving in the A1 direction. Specifically, primary transfer rollers 12Y, 12M, 12C, and 12BK, primary transfer means, are disposed at positions opposite the respective photoreceptor drums 20Y, 20M, 20C, and 20BK with the transfer belt 11 sandwiched in between. And the primary transfer rollers 12Y, 12M, 12C, and 12BK each apply voltage to the transfer belt 11 at a shifted timing from upstream to downstream in the A1 direction so that the toner images formed on each of the photoreceptor drums 20Y, 20M, 20C, and 20BK are superimposedly transferred at the same position on the transfer belt 11.

The transfer belt 11 is formed of a base layer and a coating layer. The base layer is formed of a material with less elasticity and the surface of the base layer is coated with a smooth material to thus form a coating layer, and a multilayer structure including a base layer and a coating layer is formed. Preferred materials for the base layer include, for example, fluorine resins, PVDF sheet, polyimide resins, and the like. In the present embodiment, polyimide is used. Preferred materials for the coating layer include, for example, fluorine resins.

Guides to prevent shifting of the belt are provided to both edges of the transfer belt 11. The guides are provided to prevent the transfer belt 11 from shifting in any direction perpendicular to the sheet surface relative to the main scanning direction as illustrated in FIG. 1 when the transfer belt 11 rotates in the A1 direction. In the present embodiment, the guides are formed of urethane rubber, but may be formed of any rubber material such as silicon rubber.

The transfer belt 11 has a width corresponding to the longer side of the A4-sized transfer sheet S. Accordingly, the image forming apparatus 100 is capable of forming an image on a sheet corresponding to the A3-sized transfer sheet S at the maximum.

The image forming apparatus 100 includes four image forming units 60Y, 60M, 60C, and 60BM; a transfer belt unit 10, as an intermediate transfer unit including the transfer belt 11, disposed above and opposite the photoreceptor drums 20Y, 20M, 20C, and 20BK; a secondary transfer device 5 as a secondary transfer means disposed opposite and at the right side of the transfer belt 11; and an optical scanning device 8, an exposure unit, as an optical writing unit to form a latent image and disposed below and opposite the image forming units 60Y, 60M, 60C, and 60BK.

The image forming apparatus 100 also includes a sheet feed device 61 such as sheet feeding cassettes in which a plurality of transfer sheets S conveyed toward the secondary transfer section 57 between the transfer belt 11 and the secondary transfer device 5 may be stacked; a registration roller pair 4 to feed the recording sheet S conveyed from the sheet feed device 61 toward the secondary transfer section 57 at a predetermined timing matched with a toner image formation; and a sensor, not shown, to detect whether a tip end of the transfer sheet S has reached the registration roller pair 4.

The image forming apparatus 100 also includes a fixing device 6 employing belt-fixing method to fix the unfixed toner image on the transfer sheet S; a conveyance roller, not shown, to convey the transfer sheet S sent out from the sheet feed device 61; a sheet feed path 32 provided with a registration roller pair 4 and the fixing device 6 in its interim; a sheet discharge roller pair 7, disposed at an end of the sheet feed path 32, to discharge the transfer sheet S on which a fixed image is formed/output to outside the main body 99; a guide member 67 to guide the transfer sheet S which has passed trough the secondary transfer section 57 disposed along the sheet feed path 32, to the fixing device 6; toner bottles 9Y, 9M, 9C, and 9BK, disposed above the transfer belt unit 10, each filled with toner of respective colors of yellow, cyan, magenta, and black; and a sheet discharge tray 17 on which the transfer sheet S discharged outside the main body 99 by the sheet discharge roller pair 7 is stacked.

The image forming apparatus 100 also includes a drive unit to rotatably drive the photoreceptor drums 20Y, 20M, 20C, and 20BK; an airflow generator including a fan or the like to generate airflows from front to back in the illustrated figure, to thus prevent an excessive temperature rise around the fixing device 6; and a controller 91 including a CPU to control entire operation of the image forming apparatus and associated memory units (ROM, RAM).

The image forming unit 60, 60M, 60C, and 60BK, the transfer belt unit 10, the optical scanning device 8, and the fixing device 6 entirely correspond to and are included in the image forming section disposed above the sheet feed device 61.

The transfer belt unit 10 includes, other than the transfer belt 11, primary transfer rollers 12Y, 12M, 12C, and 12BK each as a primary transfer bias roller; a drive roller 72 as a driving member around which the transfer belt 11 is wound; a cleaning opposite roller 74 as a tension roller; tension rollers 75 and 33 both serving as support rollers together with the drive roller 72 and the cleaning opposite roller 74 over which the transfer belt 11 is stretched; and a cleaning device 13 disposed opposite the transfer belt 11 and serving to clean the surface of the transfer belt 11.

The transfer belt unit 10 further includes a driving system including a driving motor to rotatably drive the drive roller 72; a power supply to apply a first transfer bias to the primary transfer rollers 12Y, 12M, 12C, and 12BK independently; and a first transfer bias controller embodied by the controller 91 as one function thereof.

The drive roller 72, the cleaning opposite roller 74, and the tension rollers 75 and 33 serve as support rollers over which the transfer belt 11 is stretched. The cleaning opposite roller 74 and the tension rollers 75 and 33 are driven rollers driven to rotate accompanied by the transfer belt 11 which is driven to rotate by the drive roller 72. The first transfer rollers 12Y, 12M, 12C, and 12BK press the transfer belt 11 from an inner surface of the belt 11 against the photoreceptor drums 20Y, 20M, 20C, and 20BK, respectively, to form a primary transfer nip. This primary transfer nip is formed on the stretched portion between the tension rollers 75 and 33. The tension rollers 75 and 33 have a function to stabilize the primary transfer nip.

A primary transfer electric field is formed at each primary transfer nip between each photoreceptor drum 20Y, 20M, 20C, and 20BM and each primary transfer roller 12Y, 12M, 12C, and 12BK due to the effect of the primary transfer bias. The toner image of each color formed on the photoreceptor drums 20Y, 20M, 20C, and 20BK is transferred primarily on the transfer belt 11 by effects of this primary transfer electric field and a nip pressure.

The drive roller 72 comes in contact with the secondary transfer device 5 via the transfer belt 11, thereby forming a secondary transfer section 57. Thus, the drive roller 72 serves also as a secondary transfer opposite roller.

The cleaning opposite roller 74 serves as a tension roller to press and give a predetermined tension suitable for the transfer operation to the transfer belt 11.

The lifetime of the transfer belt 11 has a length substantially equal to the integer multiple of that of the photoreceptor drums 20Y, 20M, 20C, and 20BK. When replacing the transfer belt 11 due to the expiry of its lifetime, if the lifetime of the photoreceptor drums 20Y, 20M, 20C, and 20BK has come to be expired, the photoreceptor drums 20Y, 20M, 20C, and 20BK also need to be replaced. Thus, by setting the lifetime of the transfer belt 11 to be substantially equal to the integer multiple of that of the photoreceptor drums 20Y, 20M, 20C, and 20BK, both members may be replaced at the same time, whereby ease of maintenance is improved, and problems such as defective transfer rate or white omissions occurring due to the rise of the friction coefficient of the photoreceptor drums 20Y, 20M, 20C, and 20BK when left without being replaced even after the lifetime expiry, do not occur.

However, without making the lifetime of the transfer belt 11 to be substantially equal to the integer multiple of that of the photoreceptor drums 20Y, 20M, 20C, and 20BK, in a case in which the transfer belt 11 is replaced due to the lifetime expiry of the transfer belt 11, it is preferred that photoreceptor drums 20Y, 20M, 20C, and 20BK be replaced when the lifetime thereof is expired or is near the expiry date, so that the ease of maintenance is improved and problems such as defective transfer rate or white omissions occurring due to the rise of the friction coefficient of the photoreceptor drums 20Y, 20M, 20C, and 20BK are restricted or prevented.

The cleaning device 13 is disposed on the left of the cleaning opposite roller 74 and the tension roller 75 as illustrated in FIG. 1. The cleaning device 13 includes a cleaning blade 76 and a case 77 in which the cleaning blade 76 is contained. The cleaning blade 76 is disposed downstream of the secondary transfer section 57 and upstream of the first transfer section 58 in the A1 direction while contacting the transfer belt 11.

The cleaning device 13 is configured such that the cleaning blade 76 scrapes off foreign substance such as residual toner and the like remaining on the transfer belt 11 and removes it from the transfer belt 11.

The transfer belt unit 10 is detachably attachable to the main body 99.

The sheet feed device 61 serves to contain a bundle of transfer sheets S, and forms a multistep configuration below the optical scanning device 8 and at the bottom of the main body 99. In the present embodiment, the sheet feed device 61 takes two-step configuration. The multistep sheet feed device 61 forms a paper bank 31 as a sheet feed section at the bottom of the main body 99.

The sheet feed device 61 includes a sheet feed roller 3 which is driven to rotate in the counterclockwise direction at a predetermined timing to press a surface of the uppermost sheet of the transfer sheets S, separate it from the bundle of transfer sheets S one by one, and send it toward the registration roller pair 4. Thus, the sheet feed roller 3 also serves as a separation roller.

The transfer sheet S fed out from the sheet feed device 61 reaches the registration roller pair 4 via the sheet feed path 32 and is pinched between the rollers of the registration roller pair 4.

The secondary transfer device 5 is disposed opposite the drive roller 72. The secondary transfer device 5 is so disposed as to sandwich the transfer belt 11 with the drive roller 72, and includes a secondary transfer roller 64, a cleaning device 65, and a spring (not shown). The secondary transfer roller 64 serves to transfer a toner image on the transfer belt 11 onto the transfer sheet S passing through the nip formed between the transfer belt 11 and the transfer roller 64. The cleaning device 65 cleans the secondary transfer roller 64, and the spring (not shown) serves as a pressing member to press the secondary transfer roller 64 toward the drive roller 72.

The secondary transfer roller 64 and part of the transfer belt 11 in the vicinity of the secondary transfer section 57 are configured to approach the sheet feed path 32. The secondary transfer roller 64 is connected to the power supply as a secondary transfer bias applying means to apply a secondary transfer bias between the drive roller 72 and the secondary transfer roller 64 and to a secondary transfer bias control means embodied as a function of the controller 91.

Specifically, the power supply applies bias with a polarity opposite the charged polarity of the toner which forms a toner image carried on the transfer belt 11, to the secondary transfer roller 64. Then, the secondary transfer roller 64 generates attractive force to the toner image carried on the transfer belt 11 due to the applied bias, and the toner image is electrostatically transferred to the transfer sheet S. With this regard, the secondary transfer roller 64 serves as an attraction roller.

The cleaning device 65 mainly includes a blade a tip of which contacts the secondary transfer roller 64, and serves to remove foreign substance such as paper dust or toner attached on the secondary transfer roller 64, thereby cleaning it.

The secondary transfer device 5 may employ an endless belt-shaped transfer member so that the transfer sheet S on which the toner image is transferred can be conveyed to the fixing device 6.

Figure 2A:
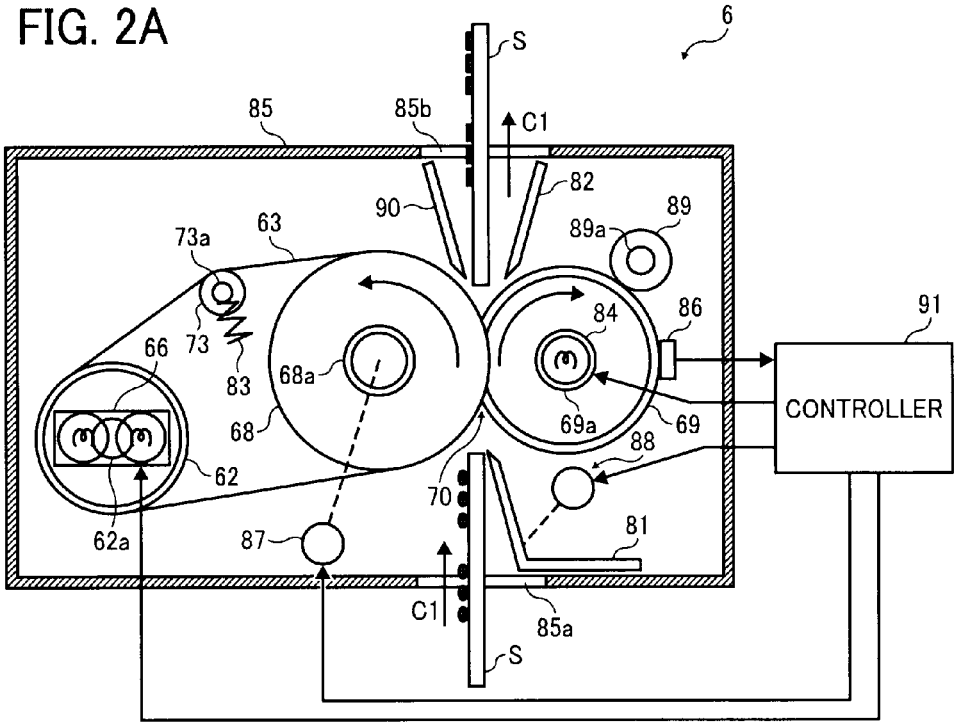
FIG. 2A is a block diagram showing a configuration of a fixing device and a controller as illustrated in FIG. 1

FIG. 2A is a block diagram of the fixing device 6 and a controller 91. As illustrated in FIG. 2A, the fixing device 6 includes a first heater 66, a heat roller 62, a fixing belt 63, a fixing roller 68, a pressure roller 69, and a second heater 84. The first heater 66 is a first heat source and the heat roller 62 is a hollow metal roller in which the first heater 66 is disposed. The fixing roller 68 is made of rubber. The fixing belt 63 is wound around the heat roller 62 and the fixing roller 68. The pressure roller 69 is a hallow roller and includes the second heater 84 as a second heat source disposed inside the pressure roller 69. The fixing roller 68 and the pressure roller 69 contact each other with pressure, thereby forming a fixing nip 70.

The fixing device 6 further includes a tension roller 73, a spring 83, and a thermistor 86. The fixing belt 63 is wound around the tension roller 73 together with the heat roller 62 and the fixing roller 68. The spring 83 serves as a pressing member to press the tension roller 73 from an inner side of the fixing belt 63 toward outside so as to increase the tension of the fixing belt 63. The thermistor 86 serves as a temperature detector to detect temperature of the pressure roller 69.

The fixing device 6 further includes an entrance guide plate 81, an exit guide plate 82, and a separator 90. The entrance guide plate 81 is disposed upstream of the fixing nip 70 in the direction indicated by an arrow C1 in FIG. 2A and opposite the pressure roller 69 and serves as an entrance side guide plate to introduce the transfer sheet S toward the fixing nip 70. The exit guide plate 82 is disposed downstream of the fixing nip 70 in the C1 direction and opposite the pressure roller 69 to guide the transfer sheet S which has passed through the fixing nip 70 toward an outside of the fixing device 6. The separator 90 is disposed downstream of the fixing nip 70 in the arrow C1 direction and opposite the fixing roller 68 to separate the transfer sheet S which has passed through the fixing nip 70 from the surface of the fixing belt 63.

The fixing device 6 further includes a cleaning member 89, a drive motor 87, a guide plate displacing unit 88, a spring (not shown), and a fixing housing 85. The cleaning member 89 has a roller shape and removes paper dust or toner attached on the outer circumference of the pressure roller 69 by contacting it. The drive motor 87 drives to rotate the fixing roller 68, thereby causing to rotate the fixing belt 63, heat roller 62, tension roller 73, pressure roller 69, and cleaning member 89, and further to convey the transfer sheet S in the C1 direction at the fixing nip 70. The guide plate displacing unit 88 serves to displace the entrance guide plate 81 in a predetermined manner which will be described later. The spring, not shown, serves as a means to press against the pressure roller 69 with the fixing roller 62 via the fixing belt 63. The fixing housing 85 includes all the parts and components related to the fixing device 6 as described above and serves as a casing to prevent any human from touching the fixing device 6 directly.

The drive motor 87, the first heater 66, the second heater 84, and the guide plate displacing unit 88 are driven and controlled by the controller 91. With this regard, the controller 91 serves as a rotation drive controller, a first heating controller, a second heating controller, and a guide plate controller. The controller 91 serves as the first heating controller and the second heating controller to drive the first heater 66 and the second heater 84 such that the temperature detected by the thermistor 86 becomes a target temperature suitable for the fixation.

The fixing roller 68 has a shaft 68*a*, the heat roller 62 has a shaft 62*a*, and the tension roller 73 has a shaft 73*a*. The shafts 68*a*, 62*a*, and 73*a* are rotatably supported in the fixing housing 85 each at a fixed position so that the rotation center of each of the fixing roller 68, the heat roller 62, and the tension roller 73 is fixed.

A shaft 69*a* of the pressure roller 69 and a shaft 89*a* of the cleaning member 89 are rotatably supported in the fixing housing 85. The pressure roller 69 is supported movably in the fixing housing 85 as to approach and withdraw from the fixing roller 68 and the fixing belt 63. The cleaning member 89 is so supported in the fixing housing 85 as to be movable accompanied by the displacement of the pressure roller 69.

Figure 3A:
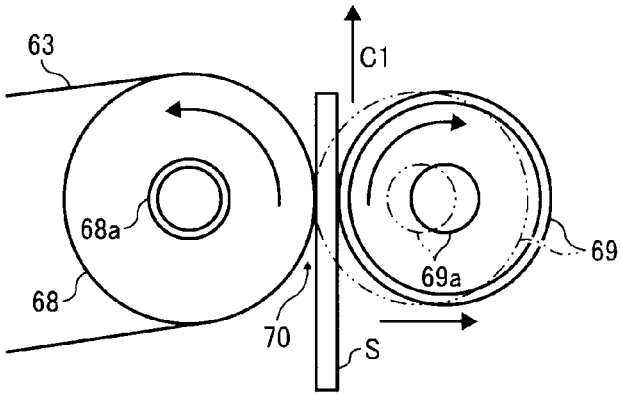
FIGS. 3A and 3B each are a front view illustrating a state in which a pressure roller as illustrated in FIG. 2A displaces.
Figure 3B:
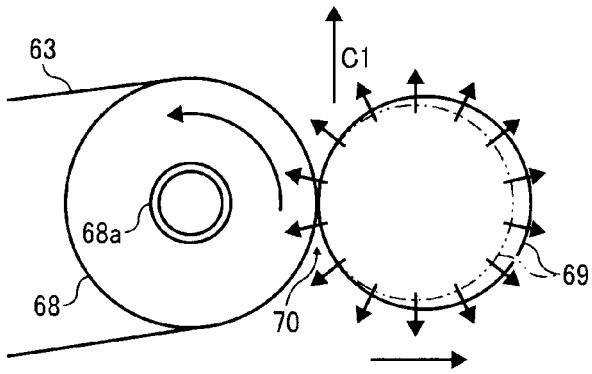

FIG. 3A is a front view illustrating a state in which the pressure roller 69 displaces when the transfer sheet S enters the transfer nip 70. FIG. 3B is a view illustrating a state in which the pressure roller 69 expands by heat. The pressure roller 69 and the cleaning member 89 are movably disposed in the fixed housing 85 and the pressure roller 69 displaces in such a manner that the pressure at the fixing nip 70 is maintained at substantially constant by the biasing force of the spring regardless of the presence or absence of the transfer sheet S entering into the transfer nip 70, the change in the thickness of the transfer sheet S, or the expansion of the pressure roller 69 itself with heat.

Figure 4:
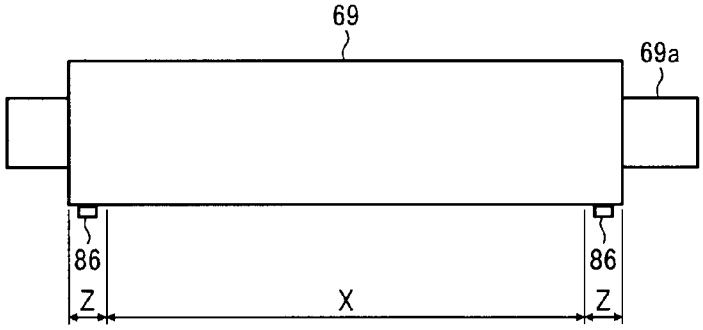
FIG. 4 is a side view schematically illustrating relative positions of the pressure roller as illustrated in FIG. 2A and an area through which a maximum-sized recording medium passes or conveyed and a state in which temperature detectors are disposed relative to the pressure roller.

As illustrated in FIG. 4, the pressure roller 69 has a width in the shaft direction which is longer than the maximum sheet-passing area X of the short side of A3-sized paper in the present embodiment and has areas Z at both end portions in which even the A3-sized paper does not pass through. Similarly to the case of pressure roller 69, the fixing belt 63, the fixing roller 68, the heat roller 62, the tension roller 73 and the cleaning member 89 are so provided as to include the maximum sheet-passing area X and portions corresponding the non-sheet passing areas Z at both ends.

Each of the fixing belt 63, the fixing roller 68, the heat roller 62, the tension roller 73, and the pressure roller 69 is a rotary member to serve as a conveyance member to convey the transfer sheet S so that the toner image carried on the transfer sheet S is fixed onto it at the fixing nip 70. The conveyance member is not limited to such a rotary member, but may be formed of a non-rotary member around which the fixing belt 63 is wound. The cleaning member 89 in the present embodiment is also a rotary member.

As illustrated in FIG. 4, a pair of thermistors 86 is disposed at both end portions of the pressure roller 69 corresponding to non-sheet passing areas Z. Each thermistor 86 contacts the pressure roller 69 and detects temperature at each disposed position where the transfer sheet does not pass through. Therefore, two or more thermistors may only have to be disposed to detect temperature difference at the non-sheet passing areas Z. The thermistors may be provided at both end portions where no sheet passes through. Alternatively, other than the pressure roller 69, the thermistors may be disposed at both end portions of any of the fixing belt 63, the fixing roller 68, the heat roller 62, and the tension roller 73.

The thermistor 86 may be a non-contact type thermistor, i.e., a thermopile. In the present embodiment, a cost-effective contact-type thermistor is used. The temperature detector such as the thermistor 86 is disposed in general at positions corresponding to the maximum sheet-passing area X. In such a case, if the contact type thermistor is used, toner or paper dust attached to any conveyance member may be accumulated at the contact portion with the thermistor which may adversely affect the detection precision, and the accumulate toner or paper dust passing through the contact portion may smear the produced image. However, as the thermistors 86 in the present embodiment are disposed at non-sheet passing areas Z, there is little possibility to smear the contact portion.

The fixing device 6 is detachably attached to the main body 99, and can be removed from the main body 99 as a single integrated unit. Such integral formation allows the fixing device 6 to be used as a replaceable part, and allows a person to access the fixing device 6 for repair in a state in which the fixing device 6 is taken out from the main body 99, thereby drastically improving the ease of maintenance.

The fixing roller 68 may be formed of any elastic member other than rubber as far as it has thermal resistivity and is endlessly shaped. The heaters 66 and 84 are halogen heaters, however, may be other type of heaters. The heaters 66 and 84 are disposed inside the heat roller 62 and the pressure roller 69, respectively, but may be disposed outside thereof. Two of the first heaters 66 are used in the present embodiment; however, one or more than two first heaters may be used. A single second heater 84 is used in the present embodiment; however, the number of second heaters used may be two or more.

Referring back to FIG. 2A, the entrance guide plate 81, the exit guide plate 82, and the separation member 90 are disposed in the fixing housing 85. The entrance guide plate 81 is disposed in the vicinity of an inlet opening 85*a* provided in the fixing housing 85, which is an entrance for the transfer sheet S. The exit guide plate 82 is disposed in the vicinity of a discharge opening 85*b*, provided in the fixing housing 85, which is an exit for the transfer sheet S.

The separation plate 90 is disposed with its end separated from the fixing belt 63. The separation plate 90 is a platelet member extending in the width direction being the axial direction of the shaft of the fixing roller 68 and may be formed in a comb shape.

The cleaning member 89 is a roller-shaped member extending in the width direction being the axial direction of the shaft of the pressure roller 69. The cleaning member 89 may be blade shaped and is not a mandatory part.

The fixing device 6 serves as a fixing member such that the transfer sheet S on which a toner image is carried passes through the fixing nip 70 sandwiched by the fixing roller 68 and the pressure roller 69, and the toner image on the transfer sheet S is fixed with heat and pressure onto the transfer sheet S. Other structure and operation related to the fixing device 6 will be described later.

The toner of each color of yellow, cyan, magenta, and black inside toner bottles 9Y, 9M, 9C, and 9BK, respectively, is polymerized toner in which wax components are uniformly dispersed, and even when the toner adheres to the transfer belt 11, the wax components do not precipitate easily. The toner of each color is supplied via the conveyance path, not shown, by a predetermined amount, to developing devices 80Y, 80M, 80C, and 80BK respectively provided to the image forming units 60Y, 60M, 60C, and 60BK.

The image forming units 60Y, 60M, 60C, and 60BK each are configured to be the same each other. Each of the image forming units 60Y, 60M, 60C, and 60BK includes, around each of the photoreceptor drums 20Y, 20M, 20C, and 20BK, along the clockwise rotation direction B1 as illustrated in FIG. 1, the primary transfer roller 12Y, 12M, 12C, or 12BK, a cleaning device 71Y, 71M, 71C, or 71BK as a cleaning means, a discharging device 78Y, 78M, 78C, or 78BK as a discharging means, a charging device 79Y, 79M, 79C, or 79BK as an AC charging means, a developing device 80Y, 80M, 80C, or 8BK as a developing means to perform development using two-component developer, and an image detector, not shown, to correct toner density and line's positional error by detecting the toner density and the line of the reference toner image formed on the photoreceptor drum 20Y, 20M, 20C, or 20BK.

Each of the image forming units 60Y, 60M, 60C, and 60BK is detachably attached to the main body 99 and can be pulled out from and pushed into the main body 99 along guide rails fixedly mounted in the main body 99, and therefore is in a form of a process cartridge detachably attached to the main body 99. Each of the image forming units 60Y, 60M, 60C, and 60BK once pushed into the main body 99 is mounted on a predetermined position suitable for the image formation and is securely located. Thus, the image forming unit integrally formed as a process cartridge may be handled as a replaceable unit, whereby the ease of maintenance is drastically improved, which is very preferable. Each part and component included in the process cartridge has a same lifetime, which prevents and restricts unnecessary replacement, and therefore the form of the process cartridge is more preferable.

When a signal to command color image formation is input to the image forming apparatus 100 as configured above, the controller 91 causes an image forming job being a print job including image information corresponding to a desired full color image to be memorized and stored in a memory, the drive roller 72 to be driven to rotate, and the photoreceptor drums 20Y, 20M, 20C, and 20BK to be driven to rotate in the B1 direction.

According to the rotation in the B1 direction, each surface of the photoreceptor drums 20Y, 20M, 20C, and 20BK is uniformly charged by the charging device 79Y, 79M, 79C, or 79BK to have a predetermined polarity. The charged surfaces of the photoreceptor drums 20Y, 20M, 20C, and 20BK are then radiated or exposure-scanned by optically-modulated laser light from the optical scanning device 8. The optical scanning device 8 radiates laser light toward upper in the main scanning direction substantially coincident to the perpendicular direction of FIG. 1. By this exposure scanning, an electrostatic latent image corresponding to each of the colors of yellow, magenta, cyan, and black is formed on the scanned surfaces thereof. This electrostatic latent image is then developed by the toner of each color of yellow, magenta, cyan, and black by the developing devices 80Y, 80M, 80C, and 80BK, respectively, thereby forming mono-color images formed of toner image of each color of yellow, magenta, cyan, and black.

In forming the electrostatic latent image by driving the optical scanning device 8, the controller 91 separates image information stored in the memory into color information of each color of yellow, magenta, cyan, and black, and, based on each color image information being a mono-color image information separated in each color, the controller 91 drives the optical scanning device 8.

The toner images of each color of yellow, magenta, cyan, and black obtained by developing operation are sequentially developed from the yellow toner image positioned most upstream in the A1 direction, to magenta toner image, cyan toner image, and black toner image, by the primary bias formed by the first transfer roller 12Y, 12M, 12C, and 12BK, at the same position on the transfer belt 11 rotating in the A1 direction, whereby a full-color synthesized color toner image is formed and carried on the transfer belt 11.

On the other hand, upon input of a signal to form a color image, any of the sheet feed devices 61 available in the paper bank 31 is selected, the sheet feed roller 3 disposed at the selected sheet feed device 61 rotates and feeds transfer sheets S and separates the transfer sheets S one by one to convey it to the sheet feed path 32, and the transfer sheet S which is fed to the sheet feed path 32 is further conveyed by the conveyance roller, not shown, and is stopped by contacting the registration roller pair 4.

At a matched timing with which the synthesized color toner image superimposed on the transfer belt 11 displaces up to the secondary transfer section 57 in accordance with the rotation of the transfer belt 11 in the A1 direction, that is, at a suitable sheet feed timing, the registration roller pair 4 rotates, and the synthesized color toner image closely contacts the transfer sheet 2 fed into the secondary transfer section 57 and is secondarily transferred and recorded onto the transfer sheet S en bloc by the effects of secondary transfer bias and nip pressure.

The transfer sheet S is then conveyed by the secondary transfer device 5 toward the fixing device 6, and while passing through the fixing nip 70 between the fixing belt 63 and the pressure roller 69, that is, the fixing section, the toner image carried on the transfer sheet S (the synthesized color toner image) is fixed by the effects of heat and pressure.

The transfer sheet S onto which the synthesized color toner image has been already fixed is then discharged outside the main body 99 via the sheet discharge roller pair 7, and is stacked on the sheet discharge tray 17 on the upper side of the main body 99.

The residual toner on the photoreceptor drums 20Y, 20M, 20C, and 20BK remaining after transfer is removed from their surfaces by the cleaning devices 71Y, 71M, 71C, and 71BK, respectively. The photoreceptor drums 20Y, 20M, 20C, and 20BK are then electrically discharged respectively by the discharging devices 78Y, 78M, 78C, and 78BK, each surface potential thereof is initialized, and are prepared for the next transfer operation.

After the secondary transfer performed when passing through the secondary transfer section 57, the surface of the transfer belt 11 is cleaned by the cleaning blade 76 provided in the cleaning device 13 and the residual toner remaining on the transfer belt 11 after the image transfer is removed, and the transfer belt 11 is prepared for the next transfer operation.

When such an image forming operation is performed, heat necessary for image fixation is generated in the fixing device 6. However, to prevent excessive temperature rise around the fixing device 6, the airflow generating means generates airflow in the main body 99. This airflow flows from front toward the rear side in FIGS. 1 and 2, and from left to right in FIG. 4. Accordingly, the front side tends to be cooler than the rear side thereof in the fixing device 6 as illustrated in FIGS. 1 and 2, and the left side tends to be cooler than the right side in the fixing device 6 as illustrated in FIG. 4.

Then, when the fixing roller 68 and the pressure roller 69 forming the fixing nip 70 show temperature variations according to the above tendency, shapes of the fixing roller 68 and the pressure roller 69 change along the shaft direction thereof depending on the thermal expansion rate of each material forming the fixing roller 68 and the pressure roller 69.

Figure 2B:
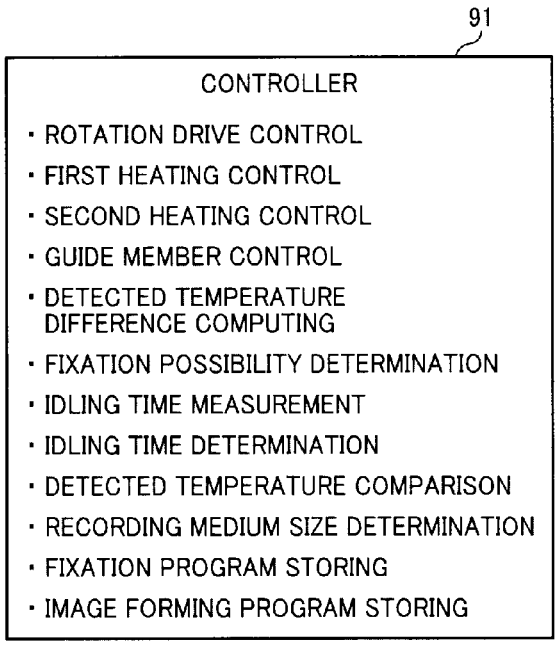
FIG. 2B shows part of the controller serving as various controlling means.

For example, since the temperature tends to be lowered at the front side than the rear side in FIGS. 1 and 2, when temperature variations occur in which the rear side temperature is higher than the front side one, the rear side diameter of the fixing roller 68 and the pressure roller 69 becomes greater than the front side diameter thereof due to the thermal expansion. Then, the conveyance of the transfer sheet S which passes through the fixing nip 70 varies and creases and curls may be generated on the transfer sheet S passing through the fixing nip 70. Otherwise, various adverse effects such as uneven glossiness of the fixed image, color superposition error, curving of the direct line, and the like may be generated.

Accordingly, in the fixing device 6 of the present embodiment, the controller 91 serving as a guide member controller drives the entrance guide plate 81 based on the temperature difference detected by the two thermistors 86, thereby reducing various defects as described above. Such temperature difference can be controlled by the controller 91. With this regard, the controller 91 serves as a detected temperature difference computing means.

In the present embodiment, the temperature of the pressure roller 69 directly forming the fixing nip 70 is detected by the thermistor 86 and therefore the detection precision is high. As described above, the thermistors 86 are disposed and detect temperature at respective non-sheet passing areas Z. Then, the thermistors 86 may be disposed at non-sheet passing areas Z at both end portions of the fixing belt 63, the fixing roller 68, the fixing roller 62, and the tension roller 73.

Among those, it is preferred that the temperature of the fixing belt 63 and the fixing roller 68 forming directly the fixing nip 70 be detected. In the above description, the fixing belt 63, the fixing roller 68, the heat roller 62, the tension roller 73, and the pressure roller 69 are recommended as temperature detection targets of the thermistor 86. In addition, if the cleaning member 89 extends to cover the maximum sheet-passing area X and respective non-sheet passing areas Z, the cleaning member 89 may also be used as a temperature detection target at which the thermistor 86 is disposed to detect the temperature, and the controller 91 can drive the entrance guide plate 81 based on the detected temperature difference. Therefore, if the cleaning member 89 extends to cover the maximum sheet passing area X and respective non-sheet passing areas Z and shows the similar temperature variation as that in the fixing nip 70, the cleaning member 89 may be used as a thermistor disposition location.

Description will be given of the operation of the entrance guide plate 81.

Figure 5:
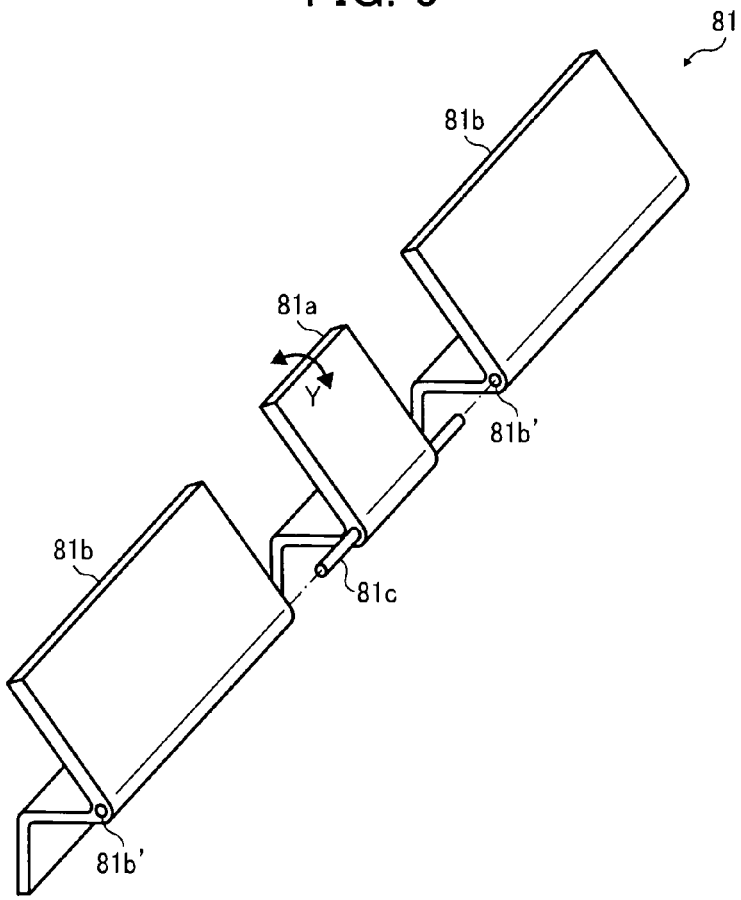
FIG. 5 is an oblique perspective view of a guide member as illustrated in FIG. 2A.

As illustrated in FIG. 5, the entrance guide plate 81 has a three-piece structure divided into three parts along the width direction of the transfer sheet S. The entrance guide plate 81 includes a central position member 81*a*, a pair of end position members 81*b*, and a shaft 81*c*. The central position member 81*a* is driven in directions indicated by a double-headed arrow Y as illustrated in FIG. 5 by the guide plate displacing unit 88 controlled by the controller 91. The pair of end position members 81*b* positioned at both sides of the central position member 81*a* in the width direction of the transfer sheet S is fixed to the fixing housing 85. The shaft 81*c* is rotatably inserted into the central position member 81*a*, is engaged with holes 81*b*' of the end position members 81*b*, and rotatably supports the central position member 81*a*.

In the present embodiment, the width of the central position member 81*a* in the width direction of the transfer sheet S is 80 mm. The width is however dependent on the relative positions of the entrance guide plate 81 in which the central position member 81*a* is included and the fixing nip 70, and is not limited to 80 mm. As far as the function of displacement, which will be described later, is exerted effectively, the entire entrance guide plate 81 may be formed to be displaceable.

Figure 6:
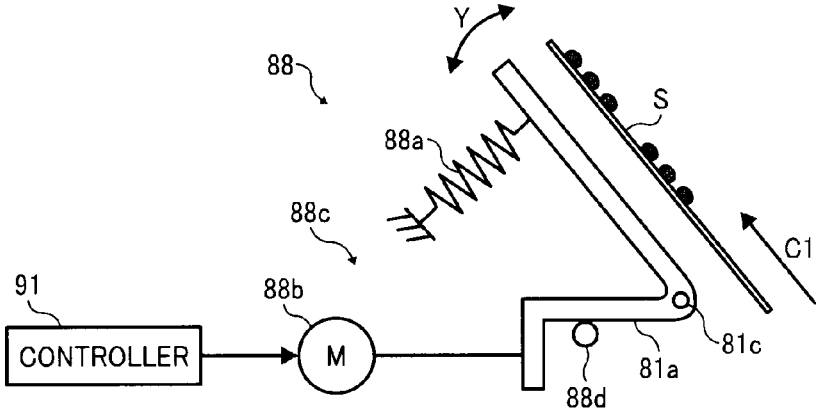
FIG. 6 is a schematic view of a guide displacing member to displace part of the guide member as illustrated in FIG. 5.

As illustrated in FIG. 6, the guide plate displacing unit 88 is connected to one end of the central position member 81*a* at the backside of the member 81*a* compared to the portion to guide the transfer sheet S and includes a spring 88*a* one end of which is fixed to the fixing housing 85 and which serves as a tension spring to bias the central position member 81*a* in the counterclockwise direction in FIG. 6 about the shaft 81*c*. The guide plate displacing unit 88 further includes a motor 88*b*, which is a drive means to be driven and controlled by the controller 91 here serving as a guide member controller; a driving device 88*c* having a gear configured to engage with the motor 88*b* and cause the central position member 81*a* to rotate clockwise against the biasing force of the spring 88*a* about the shaft 81*c*; and a pin 88*d*, a regulatory member to control rotation of the central position member 81*a* against the biasing force of the spring 88*a* when the driving device 88*c* is at rest.

The spring 88*a* prevents displacement of the central position member 81*a* due to the backlash of the gear of the driving device 88*c*. The controller 91 serving as the guide member controller adequately drives the motor 88*b* and moves the central position member 81*a* in the Y-direction orthogonal to the conveyance surface of the transfer sheet S conveyed to the fixing nip 70, which is part of the sheet feed path 32, to thus control the projected amount of the central position member 81*a* to guide the transfer sheet S, with results as illustrated in FIG. 7 described later. The height of the central position of the entrance guide plate means a projected amount or displacement amount of the central position member 81*a* in a direction orthogonal to the guided surface of the transfer sheet S with reference to the surface of the transfer sheet S guided by the pair of end position members 81*b*. The pin 88*d* controls to rotate the central position member 81*a* such that the projection amount at a portion to guide the transfer sheet S of the central position member 81*a* rotatably biased about the shaft 81*c* by the biasing force of the spring 88*a* when the driving device 88*c* is at rest, becomes zero, that is, such that the central position member 81*a* and the pair of end position members 81*b* at the portion to guide the transfer sheet S take a same position in a phase about the shaft 81*c*.

The driving means may be a motor and a solenoid. The motor is preferable because the position of the central position member 81*a* can be set arbitrarily.

FIG. 7 is a table showing the results of an experiment conducted in which creases and defective images formed on the transfer sheet S after the transfer operation were evaluated depending on the thickness of the sheet, height of the central portion of the entrance guide plate, and an absolute value of the deference in the detected temperature ΔT by each thermistor 86. In the table, "○" indicates Good, in which creases and defective images are not observed and with no problem, and "x" indicates No Good, in which abnormal creases and defective images are observed.

As seen from the table, when ΔT<10° C., no problem is observed, and no change was observed in the obtained results even though the central height of the entrance guide place is 0 mm or various other values. Accordingly, when ΔT<10° C., the central position member 81*a* is so controlled as not to be displaced.

When 10° C.≤ΔT<20° C., as the height of the central portion of the entrance guide plate becomes greater, observation results of creases and the like are improved, which we understand that the allowance to the creases and the like is broadened. Then, when 10° C.≤ΔT<20° C., the displacement of the central position member 81*a* is preferably controlled to be within a range substantially from +1.0 mm to +2.0 mm.

When 20° C.≤ΔT, observation results of creases and the like are all defective regardless of the height of the central portion of the entrance guide plate. Therefore, the central position member 81*a* is so controlled as not to be displaced. In addition, the conveyance of the transfer sheet S to the fixing nip 70 is stopped. Namely, the transfer sheet S is not allowed to be conveyed to the fixing device 6, i.e., the sheet conveyance thereto is prohibited and the image formation is stopped. This determination is performed by the controller 91, as a means to determine whether the fixation operation is possible or not. As such, in the fixing device 6, under the condition that ΔT is more than the predetermined temperature, conveyance of the transfer sheet S to the fixing nip 70 is stopped. ΔT being higher than the predetermined temperature, for example, 20° C. may be used as the condition.

To supplement additional matters not appearing in FIG. 7, if ΔT is 10° C. or the like, the above problem would not occur. If ΔT is equal to or exceeds 20° C., defects of creases and curls due to the defective conveyance occur. When ΔT is equal to or exceeds 15° C., the glossiness changes slightly, but in the case of 20° C. or less, the defective conveyance-related effect is small.

Then, the temperature difference of 15° C. being the second temperature less than 20° C., which is the first temperature, is preferably used as a threshold value in the control by the controller 91.

A control operation using the threshold value of 15° C. will now be described with reference to FIGS. 8 and 9.

Figure 8:
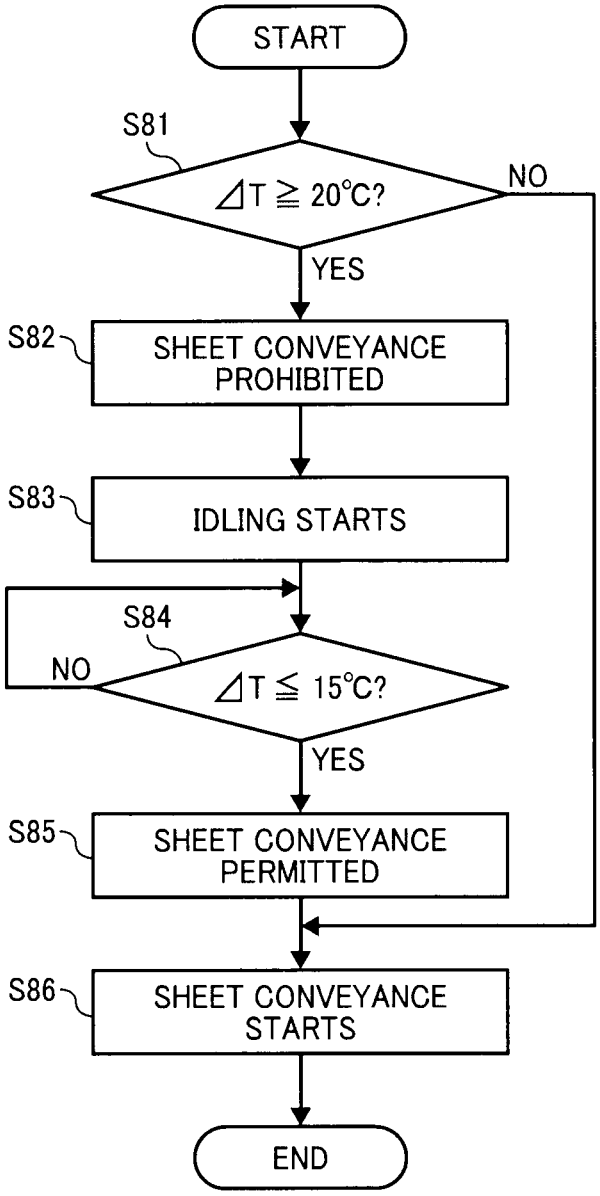
FIG. 8 is a flowchart showing an example in which operation of the fixing device as illustrated in FIG. 2 is controlled.

In the control operation as illustrated in FIG. 8, when a command to prepare image formation is received, the controller 91 as the detected temperature difference computer computes to obtain ΔT, and the controller 91 as the fixation possibility determiner determines whether 20° C.≤ΔT or not (in step S81). If 20° C.≤ΔT, the sheet conveyance is prohibited (in step S82). Subsequently, to lessen ΔT swiftly, the controller 91 as the rotation drive controller drives the drive motor 87 to cause the fixing belt 63, the fixing roller 68, the heat roller 62, the tension roller 73, and the pressure roller 69 to idle (in step S83), and the controller 91 as the fixation possibility determiner determines whether ΔT≤15° C. or not (in step S84). This determination is to be performed until it is determined that ΔT≤15° C. When it is determined that T≤15° C., the controller 91 as the fixation possibility determiner releases a command to stop conveyance of the transfer sheet S into the fixing nip 70 and allows the transfer sheet S to be passed therethrough (in step S85), thereby allowing the transfer sheet S to pass through the fixing nip 70 (in step S86). Upon determining that ΔT<20° C. in step S81, the process proceeds to step S86 immediately. By controlling as above, even though there is slight difference in the glossiness, image fixation with restricted creases and curls due to the conveyance-related defects may be performed swiftly.

The idling as described above is performed to make the temperature difference ΔT to be lower and can be omitted when a sufficient waiting time is available.

Figure 9:
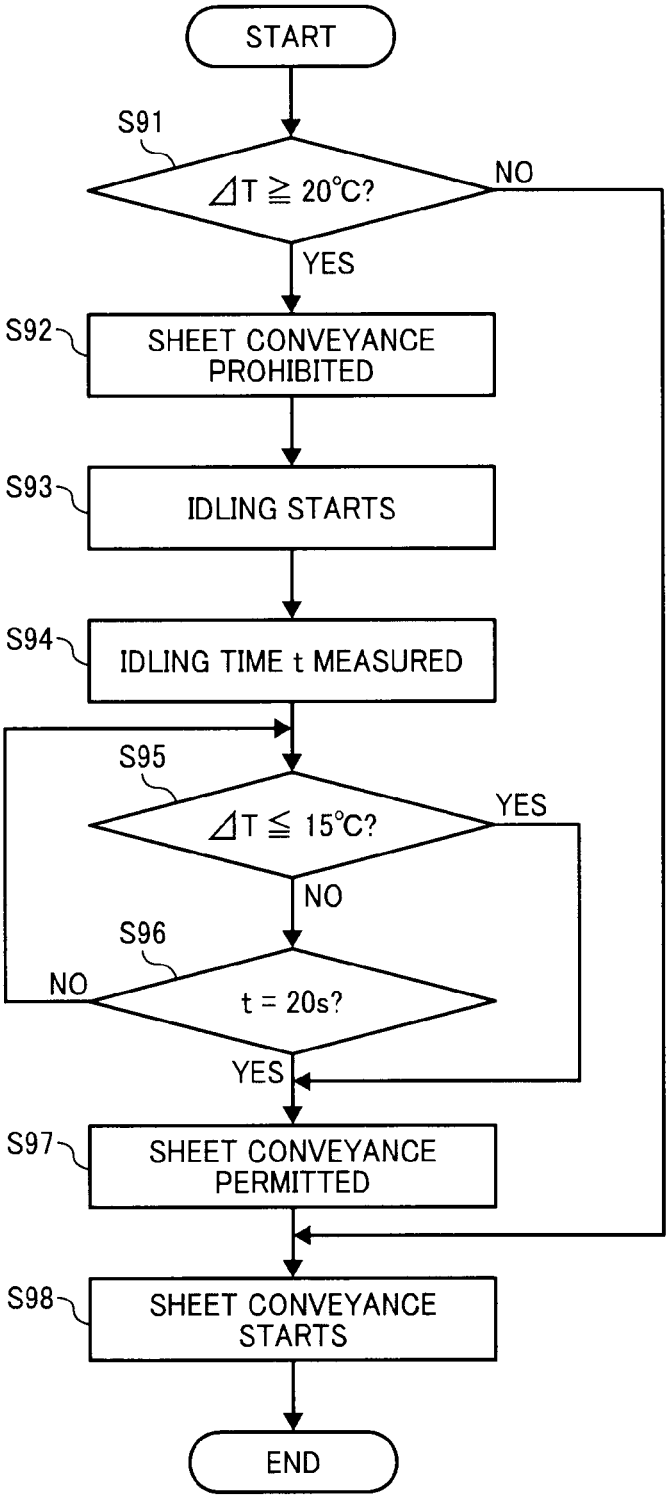
FIG. 9 is a flowchart showing another example in which operation of the fixing device as illustrated in FIG. 2 is controlled.

The determination in step S84 may be performed to determine whether ΔT<15° C. rather than ΔT≤15° C. or not, which will be applicable to an example of control in step S95 of FIG. 9.

In the control as illustrated in FIG. 9, steps S91 to S93 are performed similarly to the steps S81 to S83, respectively. When idling starts in step S93, the controller 91 as the idling time counter counts an idling time t (in step S94), and the controller 91 as the fixation possibility determiner determines whether ΔT≤15° C. or not (in step S95). If it is determined that 15° C.<ΔT, it is determined whether a time t of 20 seconds elapses (in step S96) by the controller 91 serving as the idling time determiner. If it is determined that the time t of 20 seconds has not elapsed in step S96, the process returns to S95. If it is determined that ΔT≤15° C. in step S95 or it is determined that the idling time t elapses 20 seconds in step S96, the controller serving as the fixation possibility determiner determines that the sheet conveyance is permitted (in step S97), and permits the sheet to start passing through the fixing nip 70 (in step S98). Specifically, when ΔT becomes 15° C. or lower, or the idling time t elapses 20 seconds, operation of steps S97 and S98 is performed. Upon determining that ΔT<20° C. in step S91, operation in step S98 is performed.

The threshold value of the time t is set to be 20 seconds for the user's convenience as a result of psychological research. Generally allowable wait time for the user is from 10 to 15 seconds and 30 seconds are too long. In addition, 20 seconds are enough to make ΔT to be 15° C. or lower when performing idling operation. Then, even before ΔT becomes 15° C. or lower, after idling operation of 20 seconds, the step S97 is to be performed. As described above, 20-second idling is enough to make ΔT to be 15° C. or lower. However, if the priority is given to the prevention of ceases and the like, the condition of ΔT 15° C. may be mandatory to start the operation in step S97. Thus, the threshold time t may be adjusted as desired, that is, both longer than 20 seconds if the user's perseverance permits and shorter than 20 seconds if priority is given to the wait time reduction are possible.

The controller 91 also serves as the first heating controller and the second heating controller. Description will now be given to the first heater 66 and the second heater 84.

To prevent lower quality image due to cold offset occurring when the temperature of the fixing nip 70 is low, and damage to the fixing device 6 including the fixing belt 63, the pressure roller 69, and other components, the controller 91 compares detected temperatures by each thermistor 86, and, based on the detected temperature which is lower than the other, the controller 91 drives the heaters 66 and 84 so that the temperature of the fixing nip 70 becomes the temperature suitable for the fixation.

Figure 10:
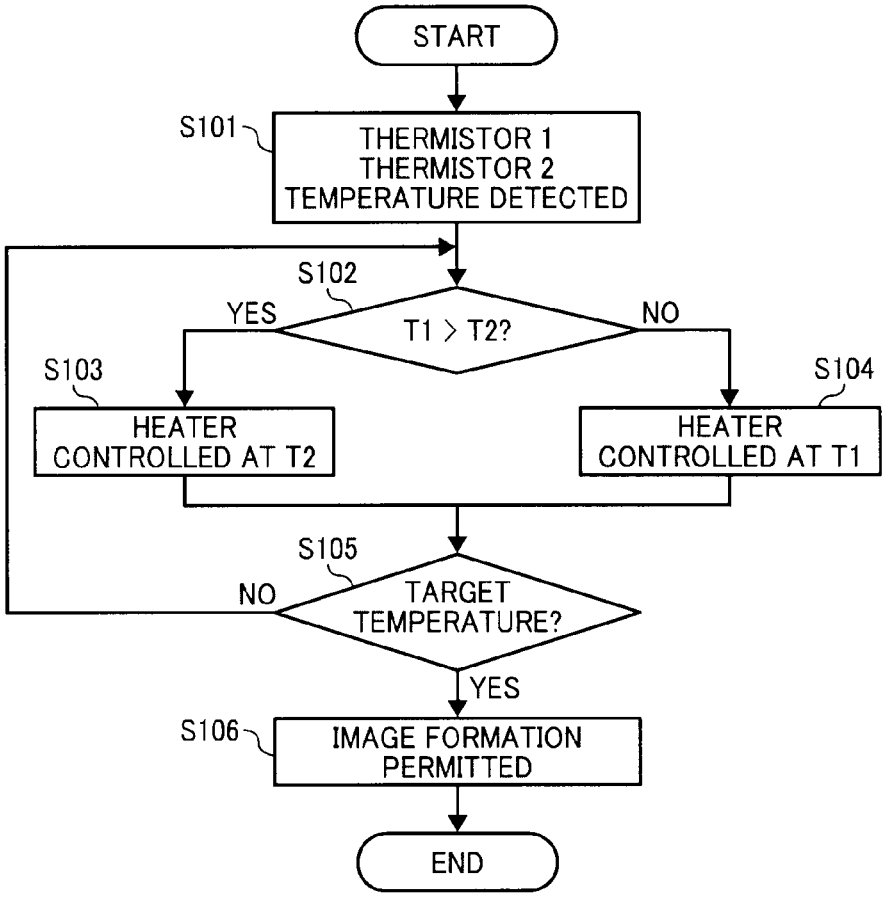
FIG. 10 is a flowchart showing further another example in which operation of the fixing device as illustrated in FIG. 2 is controlled.

Specifically, operation of the controller 91 will be described referring to FIG. 10. In FIG. 10, to clarify the operation in the present embodiment, each thermistor is specified as a thermistor 1 and a thermistor 2. The temperature detected by the thermistor 1 is T1, and that detected by the thermistor 2 is T2.

First, the thermistor 1 and the thermistor 2 detect temperature (in step S101), and the detected temperatures T1 and T2 are compared (in step S102). When T1>T2, the heaters 66 and 84 are controlled based on T2 (in step S103). When T1 is not higher than T2, the heaters 66 and 84 are controlled based on T1 (in step S104). Subsequently, whether or not each of T1 and T2 attains a target temperature is determined (in step S105). The target temperature means a temperature of the fixing nip 70 suitable for the image fixation. If it is not determined that the target temperature is attained, the step returns to the step S102. If it is determined that the target temperature is attained, the process moves to a step S106 as in the step S85 or S97 in which image formation is permitted, and similar operation is performed.

When more than three temperature detectors are provided, based on the lowest temperature detected by the thermistor detecting the lowest temperature, the heaters 66 and 84 are controlled.

By being controlled as above, the decrease in the temperature at the fixing nip 70 is prevented, and the low image quality or damage to the components due to the cold offset caused by the sudden drop of the temperature at the fixing nip 70 may be restricted or prevented.

It is also possible to perform controls using the plurality of thermistors 86, that is, making use of the temperature difference ΔT or the lowest detected temperature only when the passing position of the transfer sheet S which passes through the fixing nip 70 corresponds to the maximum sheet passing area X. This is because the temperature variations adversely affect the conveyance and fixing properties such as occurrence of creases and the most adverse affects may occur when fixing the maximum-sized transfer sheet S. According to the present control, even when the maximum-sized transfer sheet S is to be fixed, the fixation operation won't stop, and the problems related to the conveyance and fixation of the transfer sheet S and resulted creases thereon can be improved and the user's wait time may be reduced.

In the controlling operation, the controller 91 serves as a recording medium size determiner to determine whether the size of the transfer sheet S for image fixation is the maximum size or not, by obtaining the size of the transfer sheet S using an image forming job stored in the memory. Alternatively, the size of the transfer sheet S may be obtained by a size detector, provided in the sheet feed device 61, to detect a size of the transfer sheet S.

Here, the controller 91 causes programs related to method of fixation and image formation to be stored in the memory. The program relates to the fixation and image formation method, in which, as described above, the pressure roller 69, respective thermistors 86, the entrance guide plate 81 to guide the transfer sheet S toward the fixing nip 70, and the guide plate displacing unit 88 to displace, based on the detected temperature difference ΔT, the central position member 81*a*, part of the entrance guide plate 81, toward a direction orthogonal to the sheet feed path 32 in the fixing nip 70 are employed. In the above method, the controller 91 or the memory serves as a fixation and image forming program storage. The fixation and image forming programs may be stored in the memory provided in the controller 91 or in various storage media such as semiconductor media (including a ROM, non-volatile memory, and the like), optical media (including a DVD, MO, MD, CD-R, and the like), and magnetic media (including a hard disk drive, magnetic tape, flexible disk, and the like). Each of the memory and other recording media serves as a computer-readable recording medium to store the fixation and image forming programs.

For example, the fixing device 6 to which the preferred embodiment according to the present invention is applied is not limited to the fixation method using the belt, but may be applied to the roller fixing method which will be described herein.

Figure 11:
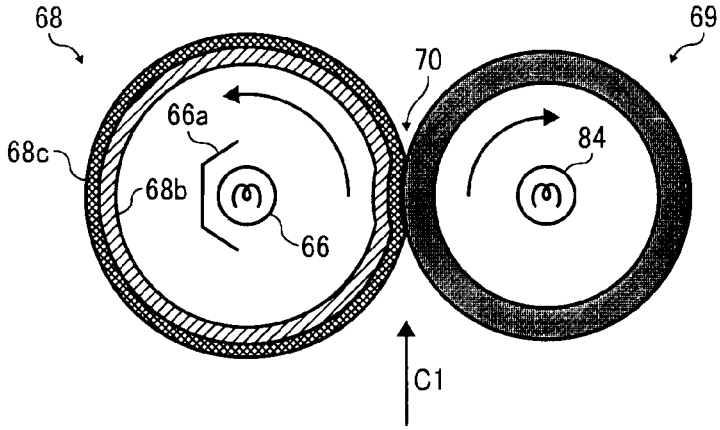
FIG. 11 is a cross-sectional view illustrating another exemplary fixing device included in the image forming apparatus.

FIG. 11 shows a fixing device using the roller fixing method. Part or component in FIG. 11 applied with a same reference numeral as employed in the description of the fixing device 6 has a same structure each other, and the detailed description thereof will be omitted. The part or component with the same reference numeral also has a same structure to cause the same controlling operation to be performed, the description of which will be omitted either. The structure of the fixing device 6 may be used in combination with the other form of the fixing device 6 as illustrated in FIG. 11.

This fixing device 6 includes the fixing roller 68, the pressure roller 69 and a reflection plate 66*a* to increase temperature rising effect of the fixing nip 70 by effectively collecting light of the heater 66 toward the fixing nip 70. The fixing roller 68 includes a metal base 68*b* and an endless belt 68*c* which closely attaches to the outer circumference of the base 68*b* and supports it. The endless belt 68*c* includes a heat-resistant sheet member formed of polyimide as a base material, and a metal layer and a release layer which are overlaid on the base sheet-like member. The base 68*b* which includes the built-in infrared heater 66 is formed of any metal materials, but may be formed of any heat-resistant resins or ceramics. The base 68*b* does not rotate, and the endless belt 68*c* displaces along the outer circumference of the base 68*b* and accompanied by the pressure roller 69. The pressure roller 69 includes a metal core and an elastic layer covering the metal core, and if appropriate, may further include a release layer on an entire or partial surface of the elastic layer. The drive means corresponding to the drive motor 87 is provided to the pressure roller 69 in the present embodiment.

In both the belt fixing method and the roller fixing method, the induction heating (IH) method may be used for the heater. In this case, in the fixing device 6 as illustrated in FIG. 11, IH coils are disposed either inside the base 68*b* or outside the base 68*b*. The materials for the base 68*b* and the endless belt 68*c* may be suitably selected depending on the type and disposed position of the heating member.

The image forming apparatus to which the present invention is applied is a tandem type apparatus and intermediate transfer method is used, but even with the tandem type apparatus, direct transfer method may be used. The present invention may also be applied to the one-drum type image forming apparatus in which color images of each color are sequentially superimposed on one photoreceptor drum to thus form a superimposed color image. The present invention may also be applied to the type of apparatus in which toner images of each color are formed and developed on the image carrier which is formed of a sheet-shaped organic photoreceptor, but in which another intermediate member is used for superimposition of the color images. The present invention may further be applied to the apparatus including a plurality of intermediate transfer members, or the apparatus using the intermediate color toner.

The present invention may be applied to the imaging apparatus in which only a mono-color image is formed, although the recent market trend is for a multi-color image-formable apparatus such as a color copier or printer.

The developer for use in the aforementioned various types of image forming apparatuses may be a two-component type developer, as image forming substance, including toner and carriers and a one-component type developer including toner only, and alternative other image forming substance requiring fixation.

The image forming apparatus is not limited to a multifunctional machine exerting functions of all or any of a copier, a printer, and a facsimile machine in combination, but is applied to a mono-functional machine including only one function.

The preferred embodiments of the present invention have been described heretofore, but the effects disclosed in the present invention are examples and not limited to the ones disclosed herein. Additional modifications and variations of the present invention are possible in light of the above teachings. It is therefore to be understood that, within the scope of the appended claims, the invention may be practiced other than as specifically described herein.

What is claimed is:

1. A fixing device comprising:

a conveyance member to convey a recording medium to a fixing nip where an image carried on the recording medium is fixed onto the recording medium, the conveyance member comprising a central portion defining a maximum size of recording medium that the fixing device can accommodate and lateral end portions outside the central portion;

a plurality of temperature detectors to detect temperatures of the conveyance member, the detectors disposed at both end portions of the conveyance member outside the central portion of the conveyance member;

a guide member comprising a guide plate to guide the recording medium toward the fixing nip;

a guide plate displacing unit to displace at least part of the guide member in a direction orthogonal to a conveyed surface of the recording medium to be conveyed at the fixing nip; and a controller that controls the guide plate displacing unit based on a temperature difference between the temperatures detected by a first of the plurality of temperature detectors at one of the end portions of the conveyance member and a second of the plurality of temperature detectors at another of the end portions of the conveyance member which is opposite to said one of the end portions.

2. The fixing device as claimed in claim 1, wherein the controller halts conveyance of the recording medium to the fixing nip under a condition in which the temperature difference is equal to or larger than a predetermined threshold value.

3. The fixing device as claimed in claim 2, wherein the controller resumes conveyance of the recording medium to the fixing nip under a condition in which the temperature difference is less than a second value which is less than a first value.

4. The fixing device as claimed in claim 3, wherein the controller resumes conveyance of the recording medium to the fixing nip when a predetermined time elapses after stoppage of the conveyance of the recording medium to the fixing nip before the temperature difference becomes less than the second value which is less than the first value.

5. The fixing device as claimed in claim 2, wherein displacement of the guide member by the guide plate displacing unit is performed under the condition in which the temperature difference is less than a predetermined threshold value.

6. The fixing device as claimed in claim 1, further comprising a heater to heat the recording medium to fix an image carried on the recording medium, wherein the heater is driven and controlled based on a temperature detected by the temperature detector that detects a lowest temperature.

7. The fixing device as claimed in claim 1, wherein the displacement of the guide member by the guide plate displacing unit is triggered by a recording medium of maximum size that the fixing device can accommodate.

8. An image forming apparatus comprising a fixing device as claimed in claim 1.

9. A fixing method comprising:

conveying a recording medium by a conveyance member to fix an image carried on the recording medium at a fixing nip, the conveyance member comprising a central portion defining a maximum size of recording medium that the fixing device can accommodate and lateral end portions outside the central portion;

detecting temperatures of the conveyance member by a plurality of temperature detectors disposed at both ends of the conveyance member outside the central portion of the conveyance member;

guiding the recording medium toward the fixing nip by a guide member; and displacing a part of the guide member in a direction orthogonal to a conveyance surface of the recording medium conveyed at the fixing nip using a guide member control by a controller based on a temperature difference between the temperatures detected by a first of the plurality of temperature detectors at one of the end portions of the conveyance member and a second of the plurality of temperature detectors at another of the end portions of the conveyance member which is opposite to said one of the end portions.

10. An image forming method comprising the fixing method as claimed in claim 9.

* * * * *